United States Patent [19]

Simonds et al.

[11] 4,401,097

[45] Aug. 30, 1983

[54] COMPOUND BOW WITH OVER-LAPPING TRACK CAMS

[75] Inventors: Gary Simonds, Gainesville, Fla.; Arnold D. McKee, Hartford, Ill.

[73] Assignee: Victor United, Inc., Chicago, Ill.

[21] Appl. No.: 275,626

[22] Filed: Jun. 22, 1981

[51] Int. Cl.[3] ..... F41B 5/00

[52] U.S. Cl. ..... 124/23 R

[58] Field of Search ..... 124/24 R, 23 R, 90, 124/DIG. 1

[56] References Cited

U.S. PATENT DOCUMENTS

| | | | |
|---|---|---|---|
| 3,851,638 | 12/1974 | Alexander | 124/24 R |
| 3,958,551 | 5/1976 | Ketchum | 124/24 R |
| 4,112,909 | 9/1978 | Caldwell | 124/DIG. 1 |
| 4,287,867 | 9/1981 | Islas | 124/24 R |
| 4,294,221 | 10/1981 | Bryant | 124/23 R |
| 4,300,521 | 11/1981 | Schmitt | 124/23 R |

*Primary Examiner*—Vance Y. Hum
*Assistant Examiner*—William R. Browne
*Attorney, Agent, or Firm*—Emory L. Groff, Jr.

[57] ABSTRACT

A compound bow includes improved cam members eccentrically mounted upon the bow limb tips and each provided with a main body section having a curved lever section extending outwardly therefrom. A groove or track in the periphery of the main body section extends about the outer periphery of the lever section to provide a continuous over-lapping track disposed in a single vertical plane. A bowstring end is disposed within each lever section track while each main body section track receives the cam end of a tension cable. Adjustable or replaceable elements allow for the ready synchronization of the two cam members as well as variation of the bow draw weight.

21 Claims, 6 Drawing Figures

COMPOUND BOW WITH OVER-LAPPING TRACK CAMS

This invention relates generally to compound bows and more particularly, to an improved eccentrically mounted cam member for mounting at the two limb tips of a compound bow.

Compound bows have become extremely popular among archers during the past 10 years. The broad concept of such bows involves the use of eccentric pulleys, wheels or cams at the limb tips about which the bow string is sheaved such that when the bow is drawn, the draw force initially rapidly builds up to its maximum intended limit and thereafter noticeably falls off as the bow is fully drawn. The purpose and advantages of such an operation is well known to those skilled in the art and need not be repeated herein.

The majority of compound bows employ a bowstring working in combination with a pair of crossing tension cables with or without the addition of other pairs of intermediate pulleys or cams. In many instances, the tension cables comprise two lengths of cable each having one of its ends joined to one of the two ends of the bowstring and thereafter passing around an adjacent pulley after which it crosses down or up to a point adjacent the opposite limb tip where it is anchored. An example of this type of compound bow will be found in the patent to Jennings U.S. Pat. No. 4,241,715 dated Dec. 30, 1980. With such an arrangement there are really only two free ends of the combined bowstring and tension cable assembly and since the pulley members each have two differently configured grooves or tracks for regulating the take-up and let-out of the respective cables and bowstring ends, it will be understood that means must be provided to transfer or cross-over each tension cable between the two adjacent grooves of each pulley, such as depicted in the referenced U.S. Pat. No. 4,241,715.

By the present invention, an improved cam member is offered including a single, substantially spiral groove or track disposed in a single vertical plane and adapted to concurrently receive and control the take-up and let-out of both a separate bowstring as well as the terminal end of one of two individual tension cables. The provision of a single, over-lapping track which is centrally mounted with respect to the bow center-line, insures that both the tension cable and bowstring which are cooperating with different portions of the single track, will at all times be aligned with the bow center-line thereby greatly enhancing the maintenance of equal force upon the bow limbs throughout the draw and release of the bow.

Users of compound bows will readily appreciate the foregoing advantages since many well known types of pulley members impart a twisting motion to the bow limb tips, in view of the off-center mounting of cables adjacent the tips of the bow limbs.

The instant cam members each include a main body section which is eccentrically mounted adjacent a bow limb tip and includes a curved outer periphery containing a groove or track which is continuous with a track provided in a lever or hook section tangent to the periphery of the main body section and projecting away from the main body section in a curved manner. One end of the bowstring is sheaved within the arcuate track of the lever section and anchored adjacent its distal portion while one end of a tension cable is sheaved about a portion of the track in the main body section and has its terminal portion secured within the body of the main body section. With the foregoing construction, a desired draw curve for any compound bow may be readily determined by the peripheral configuration of the cam lever section as well as the main body section and synchronization or tuning of the two cam members in any one compound bow as well as alteration of its draw weight, may be readily accomplished in view of releasable means provided for adjustably anchoring the terminal portions of both the bowstring and the tension cables.

Accordingly, one of the objects of the present invention is to provide an improved compound bow having a pair of eccentrically mounted cams each having a single, substantially spirally configured track concurrently receiving one end of a tension cable and one end of a bow string.

Another object of the present invention is to provide an improved compound bow having a pair of eccentrically mounted cams each having a main body provided with a peripheral track joined to a peripheral track formed in an outwardly curved lever section with the two tracks disposed in a single vertical plane.

Still another object of the present invention is to provide an improved compound bow having a pair of eccentrically mounted cams each including a single continuous track having one portion overlapping another portion in the same plane thereof and provided with means for varying in the field the location of the pivot axis of the cam.

A further object of the present invention is to provide an improved compound bow having a pair of eccentrically mounted cams with each provided with a single substantially spiral groove concurrently receiving the distal portion of a bowstring and the distal portion of a tension cable with the adjacent portions of both the bowstring and tension cable aligned with the center-line of the bow both during draw and release of the bowstring.

With these and other objects in view which will more readily appear as the nature of the invention is better understood, the invention consists in the novel construction, combination and arrangement of parts hereinafter more fully described, illustrated and claimed.

Similar reference characters designate corresponding parts throughout the several figures of the drawing.

Figure 1:
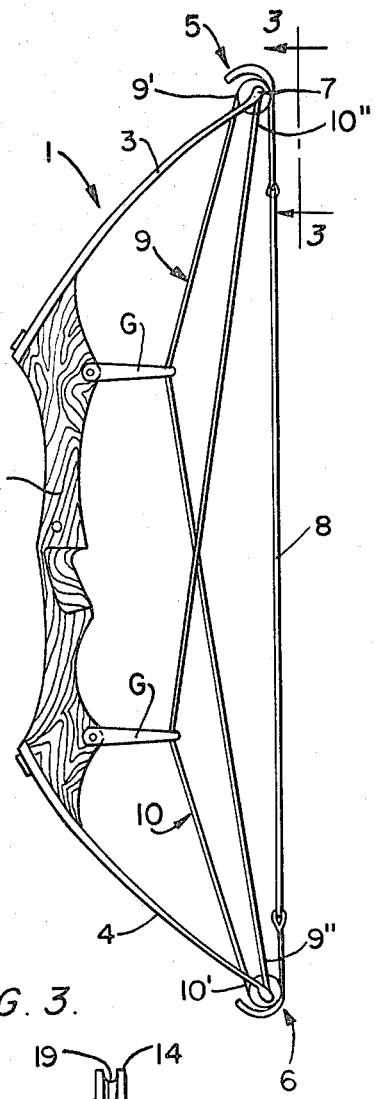
FIG. 1 is a side elevation of a compound bow according to the present invention.
Figure 3:
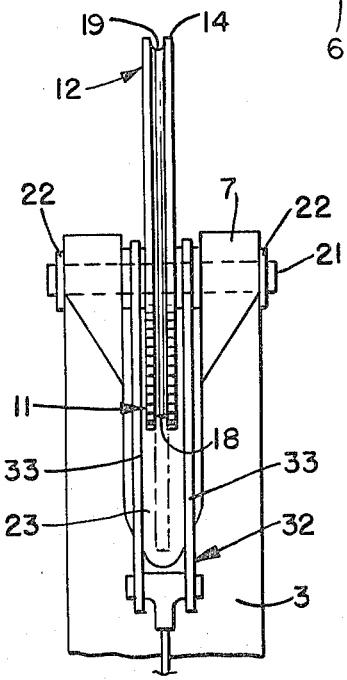
FIG. 3 is a rear elevation taken along the line 3—3 of FIG. 1.

Referring now to the drawing, particularly FIG. 1, the present invention will be understood to relate to a compound bow, generally designated 1, including a central handle 2 to which are attached an upper limb 3 and lower limb 4. The essence of the present invention relates to the construction of the cam members 5 and 6 mounted adjacent the two bow limb tips 7 and the relationship of these cams to the bowstring 8 and the two tension cables 9 and 10. In this respect, it will be appreciated that the specific construction or configuration of the bow handle 2 and its limbs 3–4 may obviously differ from that as illustrated in the drawing. Likewise, although the cams 5 and 6 are illustrated in FIGS. 1 and 3 as being mounted for arcuate displacement between the split ends of the bow limb tips 7, it will be understood that other well known means for mounting the cams may be employed such as brackets as depicted in the previously referred to U.S. Pat. No. 4,241,715. Additionally, the inclusion of tension cable guides G to maintain the crossing point of the cables 9 and 10 clear of the bowstring nocking point and/or the arrow axis, is entirely optional.

Figure 2:
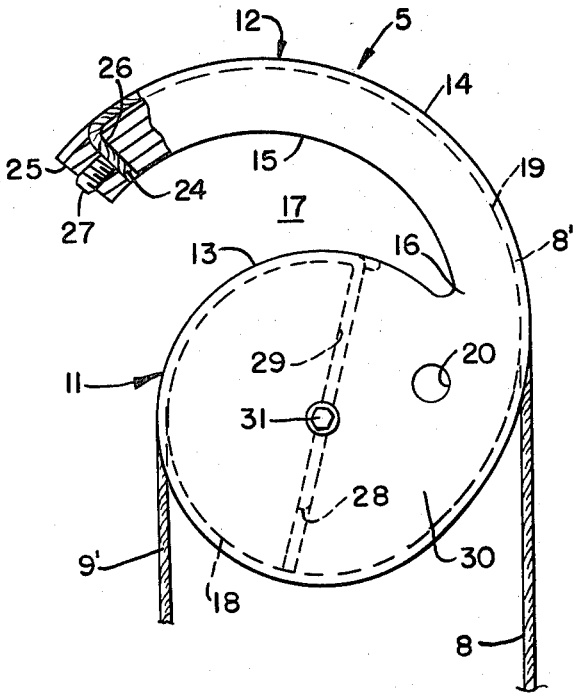
FIG. 2 is an enlarged side elevation of the top-most cam of FIG. 1.

FIG. 2 of the drawing clearly illustrates the construction of the cam 5 associated with the upper limb 3. This cam 5 is actually identical to the cam 6 located on the lower limb 4 and is merely turned over 180° before attachment thereto. With additional reference to FIG. 3, it will be seen that the cam member comprises a relatively thin planar member including a main body section 11 having an outwardly extending and curved lever or hook section 12 projecting forwardly of the plane of the main body section. Preferably the two sections 11–12 are formed as an integral element. The majority of the outer curved periphery 13 of the main body section 11 will be seen to define a substantially round configuration although, as will be discussed hereinafter, the configuration of this periphery 13 may be modified.

The lever or hook section 12 includes an outer curved periphery 14, the radius of which is substantially greater than that of the main body section periphery 13 and includes an inner periphery 15 joined to the main body section at the juncture 16 so as to provide a significant space or clearance 17 between the hook section 12 and main body section 11. The periphery 13 of the main body section 11 is provided with a tension cable groove or track 18 while the periphery 14 of the hook section 12 is provided with a bowstring groove or track 19. For ease of manufacture, the tracks 18 and 19 are preferably continuous that is, that portion of the main body section track 18 adjacent the bowstring 8 as viewed in FIG. 2 continues in a tangent manner with the lower portion of the hook section groove 19.

The cams are intended to be mounted adjacent the bow limb 7 to allow arcuate displacement thereof about an axis which is eccentric to the center of the main body section 11 and accordingly, pivot support means in the form of a pivot shaft bore 20 is provided therethrough and adapted to be journaled about a pivot shaft 21 fixedly disposed relative the bow limb tips such as by the retainers 22. In the illustrated compound bow 1 in FIG. 1, this arrangement positions a substantial portion of each main body section 11 within the space 23 defined between the split limb tips such that the coplanar overlapping track segments 18 and 19 will be aligned with the center-line of the bow limbs.

The bowstring end portions 8' are intended to be sheaved within the track 19 of each hook section 12 with one distal portion 24 anchored adjacent the hook section tip 25. This anchoring is readily achieved such as by providing a bore 26 extending through the hook section between its periphery 14 and inner periphery 15 and situated adjacent the hook section tip 25 such that the bowstring end 24 may be variable positioned within this bore 26 and thereafter secured by means of a bowstring fastener 27 comprising any suitable releasable member such as a set screw. It will be understood that the bowstring 8 will have its two opposite ends 24—24 suitably anchored with respect to the hook section 12 of the two cams 5 and 6. This bowstring 8 may comprise a unitary cable or alternatively, a medial bowstring 8 as shown in FIG. 1, in turn releasably joined to two terminal bowstring segments which in effect still provides a single length bow string having two ends 24—24. The advantage of providing a multi-part bowstring as illustrated in FIG. 1 allows the archer to readily replace only that portion of the bowstring which usually initially shows wear, such as in the area of the nocking point.

The primary purpose of the track 18 of the main body section 11 is to receive the cam portion 9' or 10' of one of the tension cables 9 or 10, respectively. This is accomplished by inserting the tension cable end 28 into a bore 29 extending through the medial portion of the main body section parallel to its two outer faces 30—30. This assembly is made by inserting the tension cable end 28 into an end of the bore 29 located at a point spaced from the juncture 16 and disposed between the hook and main body sections of the cam and when each tension cable is properly adjusted, this adjustment is retained by tightening of suitable anchoring means such as the set screw 31 passing through a tapped bore in one of the outer faces 30 and communciating with the bore 29.

The opposite anchor portion 9'' or 10'' of each tension cable is appropriately secured with respect to the other bow limb tip. Suitable anchoring means for the tension cable 10 is shown in FIG. 3 of the drawing and comprises a tension cable anchor assembly generally designated 32 including a pair of side elements 33—33 engaging the anchor portion 10'' of the tension cable on the one hand and pivotally carried by the cam pivot shaft 21 on the other hand. With this arrangement, it will be seen that the anchor portions of the tension cables are maintained in alignment with the bow center-line just as are the cam ends of the tension cables and the bowstring that are sheaved about the cam tracks 18 and 19.

Figure 4:
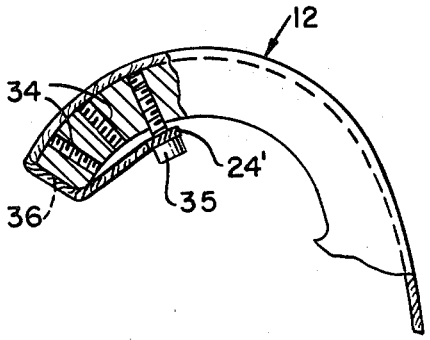
FIG. 4 is a fragmentary side elevation, partly in section, showing an alternate bowstring anchor means.

FIG. 4 of the drawing illustrates a modification of the anchoring means for the two ends of the bowstring 8 whereby alternate means are provided for adjustably securing the bowstring ends. In this view, a plurality of tapped bores 34 are provided through the hook section 12 leading from its inner periphery 15 toward its outer periphery 14 with each bore 34 located a different distance from the tip 25 of the hook section such that relative adjustment between the bowstring and the cam may be achieved by selectively inserting a threaded fastener 35 about which the distal portion 24' of the bowstring is looped into any one of the openings 34. A groove 36 formed in the hook section tip 25 assists in maintaining alignment of the end portion of the bowstring.

Figure 5:
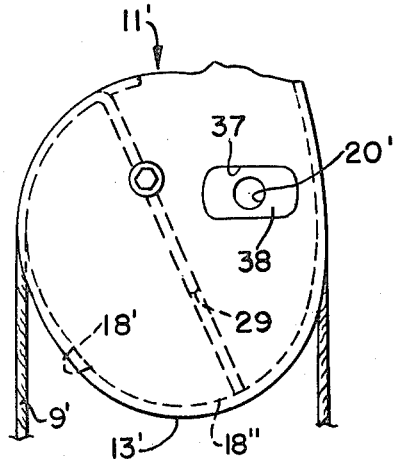
FIG. 5 is a fragmentary side elevation of an alternate cam construction.
Figure 6:
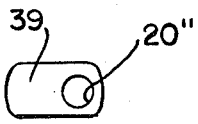
FIG. 6 is a side elevation of a replacement bushing for use in the cam illustrated in FIG. 5.

Two further modifications are illustrated in FIGS. 5 and 6 of the drawing. The alternate main body section 11' of FIG. 5 will be seen to include an outer curved periphery 13' having a modified configuration. Thus, it will be appreciated that the draw curve or let-off point of the draw force may be readily changed by modifying the curvature of the main body section periphery such as by increasing and/or decreasing the radius of curvature at selected areas throughout the extent of the track 13'. The pronounced lobe in the lower part of the cam of FIG. 5 is formed as a result of constructing that portion of the track 18' with a larger radius than in the cam 11 and by forming the portion 18'' with a smaller radius than in the cam 11. With such a configuration as in the cam 11', it will be understood that during the draw of the bowstring, the cam will be pivoted clockwise and as the bowstring is let-off the hook track 19, the tension cable portion 9' will be taken up by the main body track portion 18' and thereafter by the track portion 18'', with varying degrees of tension being transmitted by the cable 9 to the opposite limb tip, in view of the varying geometry of the curved periphery 13'.

Additionally, means are shown for relocating the pivot axis of the cam relative its supporting pivot shaft 21. Instead of providing a fixed cylindrical bore 20 through the body of the cam, an elongated opening 37 may be formed therethrough for reception of a mating bushing 38 which in turn is provided with a pivot shaft bore 20' as shown in FIG. 5. Relocation of the axis of the cam may then be readily accomplished by removing the bushing 38 and replacing it with another bushing 39 as shown in FIG. 6 wherein its pivot shaft bore 20'' is located to one end of the bushing. With such an arrangement, actually only the two illustrated bushings would be needed to provide three different pivot axis locations since the off-set bushing 39 may be turned 180° to provide a pivot axis situated closer to the center of the cam main body section 11'. The removable bushing means 38-39 may, of course be utilized with either form of cam 11' or 11.

From the foregoing it will be appreciated that an improved compound bow has been devised including cam members having a unique overlapping single track for receiving the free ends of both a bowstring and tension cable and allowing for the independent adjustable anchoring of both of these free ends in order to readily fine tune or synchronize the two opposite cams as well as enabling variation of the bow draw weight.

We claim:

1. In a compound bow including a handle, upper and lower limbs extending from said handle and each having a tip, pivot support means mounted adjacent each said limb tip, a cam member eccentrically mounted for pivotal displacement upon each said pivot support means, a bowstring spanning and engaging said two cam members, a pair of tension cables, each said tension cable having a cam portion engaging one said cam member and an opposite anchor portion secured adjacent an opposite one said cam member, the improvment comprising, said cam members each including a main body section provided with an outer curved periphery, said main body section having an eccentrically disposed bore engageable with said pivot support means, a hook section extending away from said main body section and provided with an outer periphery, each said cam member main body section and hook section disposed in a common vertical plane, a track in both said main body and said hook section peripheries, said bowstring having opposite end portions respectively disposed in said hook section tracks of said two cam members, and said tension cable cam portions respectively disposed in said main body tracks of said two cam members.

2. A compound bow according to claim 1 wherein, said main body and hook section tracks of each said cam member are disposed in a common vertical plane.

3. A compound bow according to claim 1 wherein, each said cam member main body section and hook section comprise an integral member.

4. A compound bow according to claim 1 wherein, said hook section outer periphery and track are curved.

5. A compound bow according to claim 4 wherein, the radius of curvature of said hook section outer periphery is greater than the radius of curvature of said main body section outer periphery.

6. A compound bow according to claim 1 wherein, said hook section track is tangent to said main body section track.

7. A compound bow according to claim 6 wherein, said hook section and main body section tracks are continuous whereby, a single cam member track is provided.

8. A compound bow according to claim 1 wherein, said tension cable cam portions terminate in a cable end, said cam member main body sections each having an internal bore communicating with said main body section track, said cable end adjustably insertable within said internal bore, and releasable anchor means carried by said main body section operable to engage and secure said cable end within said internal bore

9. A compound bow according to claim 1 wherein, the majority of said main body section track comprises a substantial constant radius.

10. A compound bow according to claim 1 wherein, the radius of said main body section track varies to provide an irregularly configured main body section track.

11. A compound bow according to claim 1 including, replaceable bushing means insertable in said main body section to vary the eccentricity of said bore.

12. A compound bow according to claim 1 wherein, said bowstring and pair of tension cables are disposed in a common plane aligned with the center-line of the bow.

13. In a compound bow including a handle, upper and lower limbs extending from said handle and each having a tip, pivot support means mounted adjacent each said limb tip, a cam member eccentrically mounted for pivotal displacement upon each said pivot support means, a bowstring spanning and engaging said two cam members, a pair of tension cables, each said tension cable having a cam portion engaging one said cam member and an opposite anchor portion secured adjacent an opposite one said cam member, the improvement comprising, said cam members each including a main body section provided with an outer curved periphery, said main body section having an eccentrically disposed bore engageable with said pivot support means, a hook section extending away from said main body section and provided with an outer periphery, said hook section radially spaced from said main body section outer periphery to define a substantial clearance therebetween, a track in both said main body and said hook section peripheries, each said cam member main body section and hook section disposed in a common vertical plane, said bowstring having opposite end portions respectively disposed in said hook section tracks of said two cam members, and said tension cable cam portions respectively disposed in said main body tracks of said two cam members.

14. A compound bow according to claim 13 wherein, said hook section and main body tracks are overlapping and disposed in a common vertical plane.

15. A compound bow according to claim 14 wherein, the combination of said hook section and main body section tracks substantially defines a spiral configuration.

16. A compound bow according to claim 13 wherein, each said bowstring end portion terminates in a distal portion, each said hook section having a tip, and releasably anchor means adjacent said hook section tip operable to adjustably secure said bowstring distal portion to said cam member.

17. In a compound bow including a handle, upper and lower limbs extending from said handle and each having a tip, pivot support means mounted adjacent each said limb tip, a cam member eccentrically mounted for pivotal displacement upon each said pivot support means, a bowstring spanning and engaging said two cam members, a pair of tension cables, each said tension cable having a cam portion engaging one said cam member and an opposite anchor portion secured adjacent an opposite one said cam member, the improvement comprising, said cam members each including a main body section provided with an outer curved periphery, said main body section having an eccentrically disposed bore engageable with said pivot support means, a hook section extending away from said main body section and provided with an outer periphery, a track in both said main body and said hook section peripheries, each said cam member main body section and hook section disposed in a common vertical plane, said bowstring having opposite end portions respectively disposed in said hook section tracks of said two cam members, each said bowstring end portion terminating in a distal portion, each said hook section having a tip, and releasable anchor means adjacent said hook section tip operable to adjustably secure said bowstring distal portion to said cam member, and said tension cable cam portions respectively disposed in said main body tracks of said two cam members.

18. In a compound bow including a handle, upper and lower limbs extending from said handle and each having a tip, pivot support means mounted adjacent each said limb tip, a cam member eccentrically mounted for pivotal displacement upon each said pivot support means, a bowstring spanning and engaging said two cam members, a pair of tension cables, each said tension cable having a cam portion engaging one said cam member and an opposite anchor portion secured adjacent an opposite one said cam member, the improvement comprising, said cam members each including a main body section povided with an outer curved periphery, said main body section engageable with said pivot support means, a hook section extending away from said main body section and provided with an outer periphery, a track in both said main body and said hook section peripheries, said hook section outer periphery and track defining a curved configuration, the radius of curvature of said hook section outer periphery greater than the radius of curvature of said main body section otuer periphery, each said cam member main body section and hook section disposed in a common vertical plane, said bowstring having opposite end portions respectively disposed in said hook section tracks of said two cam members, and said tension cable cam portions respectively disposed in said main body tracks of said two cam members.

19. A compound bow according to claim 18 wherein, each said bowstring end portion terminates in a distal portion, each said hook section having a tip, and releasably anchor means adjacent said hook section tip operable to adjustable secure said bowstring distal portion to said cam member.

20. In a compound bow including a handle, upper and lower limbs extending from said handle and each having a tip, pivot support means mounted adjacent each said limb tip, a cam member eccentrically mounted for pivotal displacement upon each said pivot support means, a bowstring spanning and engaging said two cam members, a pair of tension cables, each said tension cable having a cam portion engaging one said cam member and an opposite anchor portion secured adjacent an opposite one said cam member, the improvement comprising, said cam members each including a main body section provided with an outer curved periphery, said main body section having an eccentrically disposed bore engagable with said pivot support means, a hook section extending away from said main body section and provided with an outer periphery, a track in both said main body and said hook section peripheries, said hook section track tangent to said main body section track, said hook section and main body section tracks continuous to form a single cam member track, said bowstring having opposite end portions respectively disposed in said hook section tracks of said two cam members, and said tension cable cam portions respectively disposed in said main body tracks of said two cam members.

21. A compound bow according to claim 20 wherein, each said bowstring end portion terminates in a distal portion, each said hook section having a tip, and releasably anchor means adjacent said hook section tip operable to adjustably secure said bowstring distal portion to said cam member.

* * * * *